US007406806B2

(12) United States Patent
Hallissy et al.

(10) Patent No.: US 7,406,806 B2
(45) Date of Patent: Aug. 5, 2008

(54) BLAST RESISTANT PREFABRICATED WALL UNITS

(76) Inventors: Gerald Hallissy, 15 Overlook Dr., Port Washington, NY (US) 11050; William G. Higbie, 985 Thompson Dr., Bay Shore, NY (US) 11706; Edward R. Fyfe, 1339 Ocean Ave., Delmar, CA (US) 92014

( * ) Notice: Subject to any disclaimer, the term of this patent is extended or adjusted under 35 U.S.C. 154(b) by 935 days.

(21) Appl. No.: 10/738,486

(22) Filed: Dec. 17, 2003

(65) Prior Publication Data

US 2005/0144900 A1 Jul. 7, 2005

(51) Int. Cl.
*E04C 2/34* (2006.01)

(52) U.S. Cl. ..... 52/481.1; 52/408; 52/309.7; 52/317

(58) Field of Classification Search ..... 52/408, 52/409, 309.7, 481.1, 317, 653.1, 742.13
See application file for complete search history.

(56) References Cited

U.S. PATENT DOCUMENTS 2,276,076 A * 3/1942 Finck ..... 52/515
3,327,442 A * 6/1967 Hermann ..... 52/309.3
3,619,437 A * 11/1971 McDonald, Jr. ..... 264/46.6
4,242,406 A 12/1980 El Bouhnini
4,471,591 A * 9/1984 Jamison ..... 52/309.9
5,192,598 A * 3/1993 Forte et al. ..... 472/71
5,365,716 A * 11/1994 Munson ..... 52/742.13
5,398,471 A * 3/1995 Spagnolo ..... 52/412
5,890,334 A * 4/1999 Hughes, Jr. ..... 52/299
6,119,422 A 9/2000 Clear
6,368,991 B1 * 4/2002 Horner et al. ..... 442/374
6,557,313 B1 * 5/2003 Alderman ..... 52/407.3
6,699,575 B1 * 3/2004 Dagher et al. ..... 428/292.4

* cited by examiner

*Primary Examiner*—Basil Katcheves
(74) *Attorney, Agent, or Firm*—Brooks Kushman P.C.

(57) ABSTRACT

Blast resistant prefabricated wall panels contain at least one panel consisting of two structural boards having a thermoset resin-impregnated fiber reinforcing layer therebetween and extending from sides of the panel, the extension wrapped at least partially around metal sole and top plates of a metal sole plate, top plate, and stud construction. The panels are capable of resisting explosive blasts without forming secondary projectiles, and are preferably attached to a building structure by energy absorbing deformable brackets.

10 Claims, 2 Drawing Sheets

BLAST RESISTANT PREFABRICATED WALL UNITS

BACKGROUND OF THE INVENTION

1. Field of the Invention

The present invention is directed to blast resistant prefabricated wall units and to the use thereof to construct building structures.

2. Background Art

Blast resistant structures in prior times were generally limited to defense installations where blasts from exploding ammunition dumps, missile lift-off failures, or the threat of enemy action reinstated consideration of such structures. Recently, however, the threat of suicide bombers, car bombs, and the like, have raised the threshold of consciousness relative to the desirability of such structures generally, in particular for desirable terrorist targets such as tall office buildings, government buildings, embassies, and the like, worldwide.

Occupants of buildings subjected to explosive blasts risk the possibility of death or injury not only by the blast itself and primary projectiles set in motion by the blast, but also by "secondary" projectiles which are originally part of the structure walls, and which are detached from the walls and accelerated inwards by the external shock wave. Thus, for example, in the case of prefabricated wall units of layers of sheetrock, masonry board or the like, conventionally fabricated with studs, sole plates, and top plates, a blast easily fragments the exterior and interior boards as the walls bend inward from the blast. The fragments become large projectiles, in many cases exceeding the destructive capacity of projectiles from the blast itself.

In U.S. Pat. No. 6,119,422, a panel construction is disclosed where wall layers such as gypsum board are bonded together with an adhesively bonded web mesh, in order to withstand impacts resulting from high winds such as those caused by tropical storms and hurricanes. However, such panels are unlikely to survive impacts from primary projectiles or the shock waves created by explosive events, and in any case, will still generate secondary projectiles in the case of the latter. No prefabricated walls are disclosed.

U.S. Pat. No. 4,242,406 discloses panels which are designed to be structural, i.e. to bear significant load, comprising a plastic surface finish adhered to a reinforcing layer prepared from an organic casting resin and containing reinforcing fibers, an intermediate bonding layer containing chopped glass fibers, and fiberglass-reinforced gypsum board as the final layer. While the panels are designed to be structural, they are not designed to resist impact. Moreover, prefabricated wall structures are not disclosed.

It would be desirable to provide blast resistant prefabricated wall units which do not fragment into secondary projectiles in the case of a blast. It would be further desirable to provide a building structure which can absorb considerable blast energy.

SUMMARY OF THE INVENTION

It has now been surprisingly discovered that blast resistant prefabricated wall units can withstand large explosive blasts without fragmenting, if the exterior and/or interior walls of the prefabricated wall units are comprised of an at least two layer construction, with a matrix resin-impregnated fiber-reinforcing layer bonded between the layers, the reinforcement continuing around top and sole plates.

DETAILED DESCRIPTION OF THE PREFERRED EMBODIMENT(S)

Figure 1:
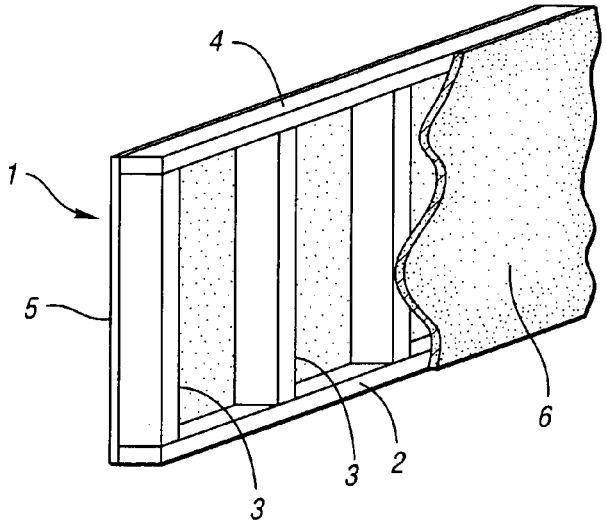
Fig. 1 (PRIOR ART)
FIG. 1 illustrates a prior art prefabricated wall unit.

A typical prefabricated wall unit 1 is shown in FIG. 1, in a perspective cutaway view. At 2 is a wood or metal (steel) channel sole plate, connected by wood or metal channel studs 3 to wood or metal top plate 4. On the exterior side of the wall unit 1 is gypsum board or masonry board 5. On the interior is a further gypsum board or masonry board 6.

Figure 2:
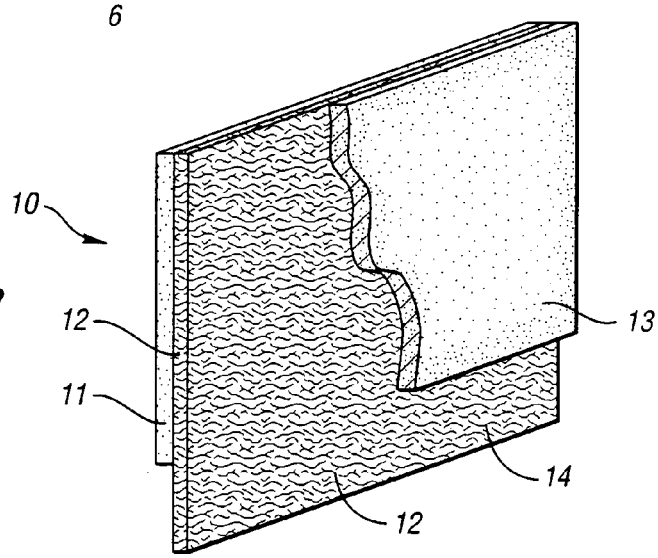
FIG. 2 illustrates a cutaway view of a panel of a blast resistant prefabricated wall unit in accordance with one aspect of the present invention.

FIG. 2 illustrates a portion of a panel 10 of the prefabricated wall units of the present invention. The panel 10 comprises a layer of structural board, preferably gypsum board or masonry board, a layer of thermoset matrix resin impregnated glass fibers 12, and a further layer of structural board 13. The studs, sole plates, and top plates are preferably of metal, i.e. steel, but may also be of wood, wood laminates, fiber-reinforced composite materials, etc.

The structural boards or "sheathing" are preferably gypsum board (wall board, plaster board) or masonry board, but may also be, preferably on the interior surface (facing the interior of the prefabricated wall panel), structural board of other types, for example, high, medium or low density particle board, oriented strand board, plywood, or the like. The gypsum board and masonry boards may optionally include reinforcing fibers within their inorganic matrix.

The layer of thermoset matrix resin-impregnated fibrous reinforcement (12) comprises minimally one layer of fiberglass, which may be woven, felted (i.e. needled), unidirectional, or combinations of these. Chopped fibers alone are generally not sufficient for the fibrous reinforcement, although in appropriate embodiments, they may be used in conjunction with other types of reinforcement, particularly felted and woven fiber reinforcement. It is preferred that the fibrous reinforcement comprise a single or a plurality of layers of unidirectional fiberglass (e-glass) reinforcement.

The fibers of the fiber reinforcement are high strength fibers, preferably glass fibers, although carbon (graphite) fibers may also be used, as well as high strength polymeric fibers, including but not limited to aramid fibers, high density polyethylene fibers, and the like. Mixtures of fibers may be used. The number of fiber layers is dependent upon the strength properties of the fibers, their configuration, e.g. unidirectional, woven, felted, or combinations thereof, and the matrix resin. With epoxy resins, from 1 to 10 layers of unidirectional glass fibers are preferred.

Preferred fibrous reinforcement is fiberglass, more preferably E-glass. The fibrous reinforcement is preferably in the form of unidirectional fabric, e.g. fabric comprising unidirectional fibers in the main, with sufficient crossfibers to maintain integrity of the fabric. A minor amount of thermoset or hot melt binder may be applied to prevent significant fraying or fiber release. The reinforcement advantageously has a tensile strength of 100,000 to 300,000 psi, more preferably 150,000 to 250,000 psi, an elongation at break of minimally 1.0%, more preferably 2.0%, and most preferably 3.0%, and a tensile modulus of minimally $5\times10^6$ psi, more preferably $10\times10^6$ psi, all measured in accordance with ASTM D2433 at 72° F. (25 DC) and 50% relative humidity. Fiber reinforcement with lesser or greater strength and elongation properties may be used as well, and when low performance fibrous reinforcement is employed, greater ultimate strength properties may be achieved through the use of additional layers. A preferred fibrous reinforcement is TYFO® BG, available from Fyfe Co. LLC, having an areal weight of approximately 27.6 oz./yd$^2$. Layups with substantially bidirectional woven fiberglass cloth, and layups employing one or more layers of the latter together with one or more layers of subtantially unidirectional fabric are also preferred.

As shown in FIG. 2, the layer 12 extends at 14 beyond the layers of structural board 11 and 13. This extension, prior to cure of the thermoset matrix is proximate the sole and top plates, and is continued over and optionally wrapped around the sole and top plates, followed by curing. This carrying of the fibrous reinforcement layer beyond the panel is necessary to achieve the benefits of the invention, and one embodiment is shown in greater detail in FIG. 3.

The thermoset matrix resin may be any employed to produce fiber-reinforced articles, for example but not by limitation, unsaturated polyester resins, vinyl ester resins, polyurethane resins, bismaleimide resins, cyanate resins, epoxy resins, etc. Epoxy resins, due to their high strength, ready availability, and relatively low cost, are preferred. It is also possible to employ thermoplastic adhesives, for example, hot melt adhesives, although not preferred due to increased fabrication costs. For example, fibrous reinforcement impregnated with a pressure sensitive or hot melt adhesive may be employed in this less preferred embodiment.

Epoxy resins are the preferred matrix resins. The epoxy resins may be used to pre-impregnate the reinforcing fibers, i.e. in the form of what is commonly called a "prepreg." However, for ease of construction, it is preferred that the epoxy resin be a liquid epoxy resin which is machine applied or hand applied to the fabric. The substrate may first be coated with epoxy, the fibrous reinforcement applied, and additional resin applied over the reinforcement, and hand worked, i.e. with rollers, brushes, trowels, or the like, to saturate the fibers. Air pockets and bubbles should be worked out by conventional hand saturation techniques, although it is permissible to have a limited number of such pockets so long as the strength of the overall panel is not compromised unduly. For hand saturation techniques, it is preferred that the curable epoxy resin composition have a viscosity in the range of 400 cps to 1500 cps, preferably in the range of 400 to 1000 cps.

A preferred epoxy resin composition is Tyfo® saturant epoxy, prepared by mixing 100 parts epoxy resin with 42 parts of hardener by volume, to produce a curable resin composition having a potlife of 2 to 4 hours at 68° F. (20° C.) and a viscosity in the range of 600-700 cps. This epoxy resin is preferably cured at ambient temperature for 24 hours followed by a post cure at 140° F. (60° C.) for 72 hours, and typically has a tensile strength of 8800 psi (61 MPa), tensile modulus of 406 Kpsi (2.8 GPa), and percent elongation of 8.0%, all as measured by ASTM D-838 Type 1; a flexural strength (ASTM D-780) of 17,900 psi (123.4 MPa) and flexural modulus (ASTM D-790) of 452 Kpsi (3.12 GPa). Tyfo® epoxy is available from FYFE Co. LLC, San Diego, Calif. Epoxy resin compositions with both lesser as well as greater cured physical properties are also suitable, and other useable epoxy resin compositions can easily be formulated by one skilled in the art. Epoxy resins may be formulated, for example, from conventional bisphenol A-based epoxy resins, from tetraglycidyltoluene diamine epoxy resins, from cyclohexene oxide-type epoxy resins, and the like. Reference may be had to the HANDBOOK OF Epoxy RESINS, Lee and Neville, McGraw-Hill, pub., ® 1967. Epoxy resin is preferably applied at a rate of about 0.2 to 2 lbs. epoxy per pound of reinforcement, preferably 0.4 to 1.5 lbs./lb, and most preferably about 0.7 to 0.9 lb/lb. Saturation may take place prior to layup onto the substrate, for example, by employing a TYFO® Saturator, available from FYFE Co. LLC.

Figure 3:
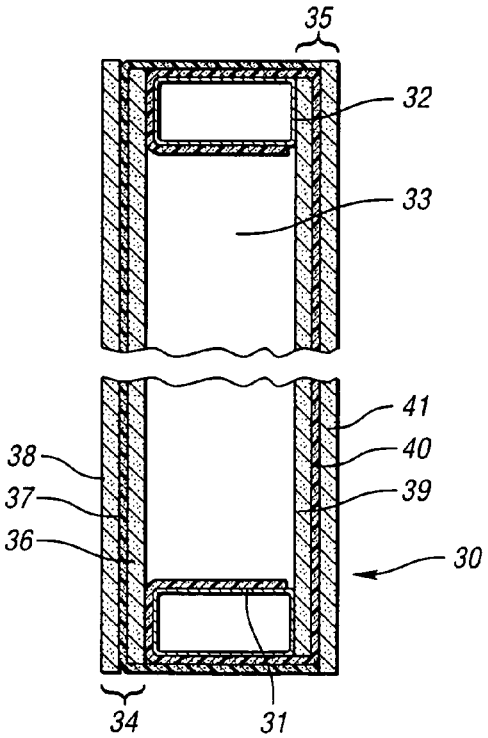
FIG. 3 illustrates an end view of a blast resistant prefabricated wall unit in accordance with one embodiment of the present invention.

FIG. 3 illustrates a cross-section of a prefabricated wall unit 30, the cross section taken between studs. At 31 is the sole plate, in this case a hollow metal channel, while at 32 is the top plate. The next stud in the assembly, 33, may be seen beyond the cross-section in the figure. In this embodiment, the wall unit contains two of the panels of FIG. 2, panels 34 and 35.

Panel 34 consists of interior gypsum board 36, fiber reinforcing layer 37, and exterior gypsum board 38, while panel 35 consists of interior gypsum board 39, fiber reinforcing layer 40, and exterior gypsum board layer 41. Not shown for clarity is thermal insulation which is preferably present, positioned between the vertical studs.

The fiber reinforcing layer 40 of panel 35 is shown wrapped completely around sole plate 31 and top plate 32. Complete wrapping around the respective plates is not necessary, nor does the space between each stud 33 between sole plate 31 or top plate 32 require wrapping, so long as the desired degree of blast resistance is obtained. It would not depart from the spirit of the invention, for example, to incompletely wrap these structural elements, for example, wrapping between alternating pairs of studs or wrapping only partially between succeeding pairs of studs. In most cases, it is only necessary to continue the fibrous reinforcement and adhesive across all or a portion, i.e. preferably greater than 30% of the width of the sole and top plates.

In FIG. 3, the fiber reinforcing layer 37 of panel 34 is also wrapped around the sole and top plates 31 and 32, in this case the wrapping extending only as far as the opposite edge of these structural elements. Of course, the fiber reinforcing layers 40 and 37 of panels 35 and 34 may be completely wrapped around the positions of the sole and top plates 31 and 32 between alternating pairs of studs. Since the wrapping of the fiber reinforcement layer occurs prior to cure, the layer of one panel may actually proceed partially up the opposing panel, prior to positioning of the outermost layer of structural board, e.g. gypsum board.

Figure 4:
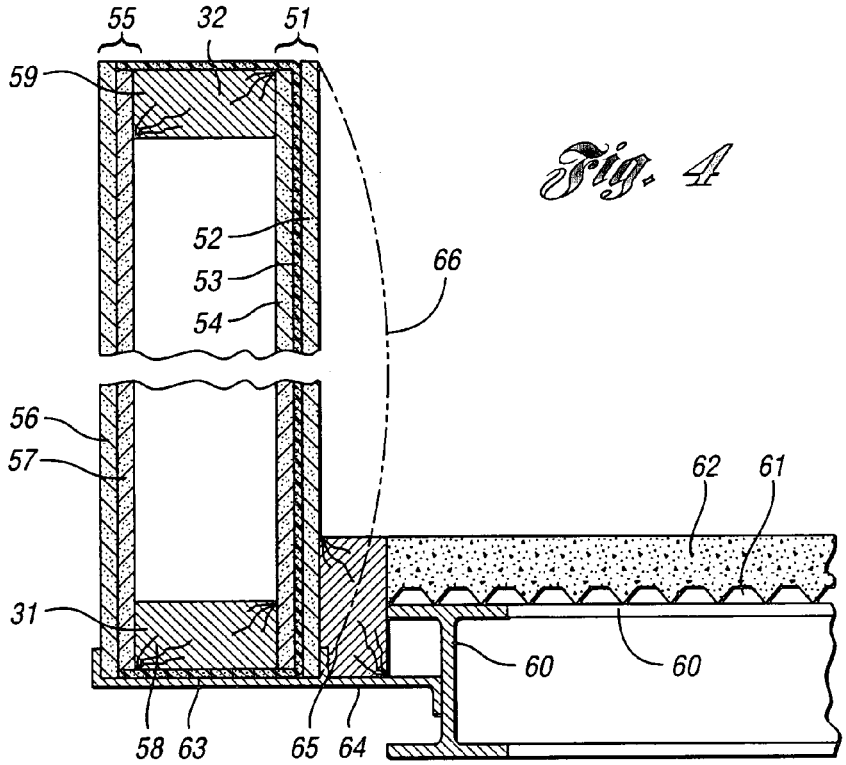
FIG. 4 illustrates an end view of a building construction employing a blast resistant wall unit in accordance with one aspect of the present invention.

While in FIG. 3 a prefabricated wall unit with two panels of FIG. 2 is illustrated, in FIG. 4, a single panel 51 is employed, with the remaining side 55 of the prefabricated wall unit 50 composed of a single, or in this case a double layer, 56, 57, of gypsum board. Note in this case that the wrapping of the sole plate 31 and top plate 32 is only partial, extending only along the top and bottom thicknesses of these elements. In embodiments employing a single panel of the subject invention, however, complete wrapping at least around the opposing corners 58, 59 of the sole plate and top plate is preferred.

Attachment of the prefabricated wall panels in a building structure may be accomplished by conventional methods utilized in the building industry, for example by employing a hollow frame structure on the exterior of the building into which prefabricated panels are mounted and fastened. In FIG. 4, a portion of a building construction is illustrated in which an energy absorbing bracket is employed to allow the prefabricated wall units of the present invention to flex and/or move inwards, helping to absorb and dissipate blast energy.

In FIG. 4, the building is constructed of steel I-beams 60, on top of which lies a corrugated metal panel 61 onto which is poured concrete to form a concrete floor structure 62. The panels 50 are held vertically by brackets 63, an attachment or extending portion 64 of which is attached to the steel I-beam support, or another structural element of the building. Between panel 50 and floor 62 is fire stop 65. In this embodiment, extension 64 of bracket 63 is designed to be deformable or displaceable so as to allow the wall panel to bow inwards as shown by dashed line 66, and/or to be displaced laterally inwards toward the building support structure. A similar bracket would ordinarily be positioned at the top of the prefabricated wall unit, or to a channel designed to locate both the prefabricated wall unit and a similar unit immediately above.

Figure 5A:
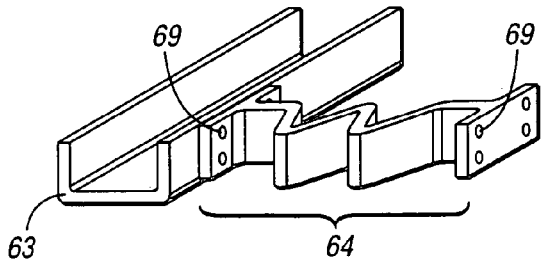
FIGS. 5*a* and 5*b* illustrate one embodiment of energy absorbing, deformable brackets useful in constructing buildings employing the blast resistant panels of the present invention.
Figure 5B:
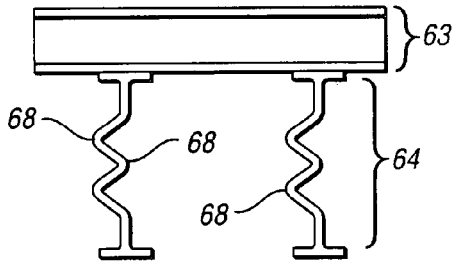

The extension 64 may take numerous forms. One such form is shown in FIG. 5*a*, wherein the extension 64 comprises a vertically pleated sheet steel structure attached to the bracket 63. The bracket and extension are shown from above in FIG. 5*b*. The vertical pleats 68 allow for substantial vertical loads to be carried, while allowing for considerable displacement inwards. This displacement, if not exceeding the elastic limits of the (preferably) steel brackets, may be totally recoverable. If it exceeds the elastic limits, all or a portion of the displacement will not be recoverable. Since in the case of an explosion, the wall units are likely to require replacement, deformed brackets can be replaced as well. The bracket extensions 64 may be welded to the bracket 63, or, as shown, may be bolted or riveted, as shown, through holes 69.

Figure 6:
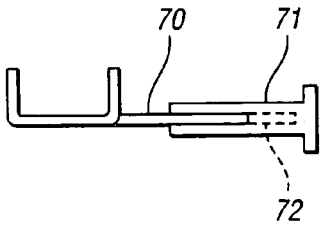
FIG. 6 illustrates a further embodiment of an energy absorbing wall panel bracket.

Other configurations for energy absorption can easily be designed by one skilled in the art, and include numerous deformable structures, including slides such as shown in FIG. 6 in cross-section, where a bracket extension 70 slides within a receiving structure 71. The space 72 may be empty or may be filled with further energy absorbing or deformable material such as an energy absorbing rigid foam, or a resilient foam. More complex energy absorbing structures such as viscoelastic dampers, pneumatic dampers, friction type or hydraulic shock absorbers and the like may all be used. One example of a viscoelastic damper is the TYFO® viscoelastic damper available from Fyfe Co., LLC. The energy absorbing brackets need not be used at all corners of a wall panel. For example, one side (top, bottom, left, or right) may be equipped with such structures while the opposing side (bottom, top, right, or left, respectively) is more rigidly anchored. In such a case, a tilting or rotating displacement of the panel may be achieved.

Having generally described this invention, a further understanding can be obtained by reference to certain specific examples which are provided herein for purposes of illustration only and are not intended to be limiting unless otherwise specified. While the examples employ steel studs and plates, it is understood that studs and plates of other materials are also suitable.

COMPARATIVE EXAMPLE 1

Figure 7:
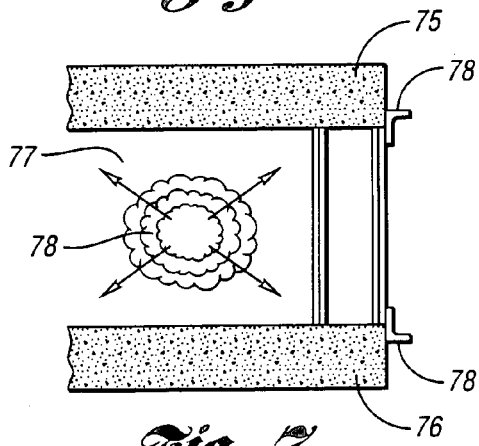
FIG. 7 illustrates a test set-up for ascertaining blast resistance of prefabricated wall units.

A prefabricated wall panel is constructed conventionally, including a steel sole plate and steel top plate of 6 inch depth connected by 6 inch deep steel studs. The exterior consists of two layers of ⅝ inch type X gypsum board, as does the interior as well. Standard 6 inch fiberglass insulation is contained between the studs. The prefabricated wall is positioned between reinforced concrete "floor and ceiling" members 75, 76 of a blast chamber 77, and maintained in this position by non-deformable brackets 78 external to the chamber, as shown in FIG. 7. An explosive charge is placed within the chamber and detonated, causing an explosive blast 78. The blast destroys the wall unit, creating numerous "secondary" projectiles which speed away from the direction of the blast chamber.

EXAMPLES 2 AND 3

Blast resistant walls are prepared as described in FIGS. 2 through 4. In each case, one panel is constructed in accordance with FIG. 2, consisting of two layers of ⅝ type X gypsum board, having one layer of TYFO® blast glass in between the layers. TYFO® blast glass consists of woven fiberglass in an epoxy resin matrix. The total thickness is about 0.125 inch. The fiberglass continues over the bottom of the sole plate and top of the top plate. The opposing wall is of two layer ⅝ inch type X gypsum board without fiberglass. The fiberglass is unidirectional e-glass supplied as a stitched unidirectional fabric, the direction of the strands being perpendicular to the length direction of the sole and top plates.

Two blast tests were constructed, in the first case with the fiber reinforced panel facing the interior of the chamber, while in the second case, the fiber reinforced panel faced the exterior of the chamber. Upon detonating the explosive charge, bending deformation of the wall panel could be observed in a direction away from the chamber. However, the panel substantially regains its original shape. No secondary projectiles are created.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A prefabricated wall panel, comprising:

a horizontally extending sole plate, a horizontally extending top plate, a plurality of vertically extending studs fixed to said sole plate and to said top plate, said sole plate, top plate, and studs forming a framework, two panel structures affixed to said framework on opposing sides of said framework, at least one of said panel structures comprising a first structural board, a second structural board, and a thermoset resin impregnated fiber reinforcing layer between said first structural board and said second structural board, said fiber reinforcing layer extending from said first and second structural boards proximate said sole plate and proximate said top plate, and extending along and affixed to at least a bottom portion of said sole plate and at least a top portion of said top plate.

2. The wall panel of claim 1, wherein said structural boards are individually selected from the group consisting of masonry board and gypsum board.

3. The wall board of claim 1, wherein fiber reinforcement of said fiber reinforcing layer comprises fibers selected from the group consisting of glass fibers, carbon fibers, aramid fibers, and mixtures thereof.

4. The wall panel of claim 1, wherein fibrous reinforcement of said fiber reinforcing layer comprises woven fabric, stitched unidirectional fabric, or a combination thereof.

5. The wall panel of claim 1, wherein said thermoset matrix resin comprises one or more matrix resins selected from the group consisting of epoxy resins, unsaturated polyester resins, vinyl ester resins, and polyurethane resins.

6. The wall panel of claim 1, wherein said fiber reinforcing layer a) proximate the sole plate wraps around the sole plate over at least a portion of the length of the sole plate; or b) proximate the top plate wraps around the top plate over at least a portion of the length of the top plate; or c) proximate to the top plate and the sole plate wraps around each of these plates over at least a portion of their respective lengths.

7. The wall panel of claim 1, wherein both said panels comprise two layers of structural board with a thermoset matrix resin impregnated fiber reinforcing layer therebetween.

8. The wall panel of claim 1, wherein fibrous reinforcement of said fiber reinforcing layer comprises woven fiberglass, and said thermoset matrix resin comprises an epoxy resin.

9. A building construction, having an internal load bearing structure and an exterior, comprising as at least a portion of said exterior, a) a plurality of the wall panels of claim 1;

b) a plurality of brackets, one or more brackets supporting said wall panels, said brackets attached to said internal load bearing structure of said building by means of an energy absorbing structure which forms a part of said bracket, which is attached to said bracket, or which operates with said bracket to allow said wall panels to be displaced inwardly towards said internal load bearing structure by the force of a blast exterior to said building.

10. The building construction of claim 9, wherein said bracket contains or is attached to a vertically pleated energy absorbing structure.

* * * * *